United States Patent [19]

Hignett

[11] 4,298,080

[45] Nov. 3, 1981

[54] ROCK CUTTING TOOLS

[75] Inventor: Henry J. Hignett, Reading, England

[73] Assignee: Secretary of State for Transport in Her Britannic Majesty's Government of the United Kingdom of Great Britain and Northern Ireland, London, England

[21] Appl. No.: 909,444

[22] Filed: May 25, 1978

[30] Foreign Application Priority Data

May 25, 1977 [GB] United Kingdom ..... 22129/77

[51] Int. Cl.[3] ..... E21D 9/10; E21C 35/18

[52] U.S. Cl. ..... 175/373; 175/365; 299/10; 299/86

[58] Field of Search ..... 175/371, 373, 351, 352, 175/365; 30/347; 172/604; 299/40, 86, 10

[56] References Cited

U.S. PATENT DOCUMENTS

| | | | |
|---|---|---|---|
| 1,374,867 | 4/1921 | Wadsworth | 175/365 X |
| 1,749,344 | 3/1930 | Hild | 175/352 X |
| 3,216,513 | 11/1965 | Robbins et al. | 308/8.2 X |
| 3,756,332 | 9/1973 | Crane | 175/352 X |
| 3,840,271 | 10/1974 | Sugden | 175/373 X |
| 3,982,595 | 9/1976 | Ott | 175/373 |
| 4,062,594 | 12/1977 | Haspert | 299/89 X |

FOREIGN PATENT DOCUMENTS

| | | | |
|---|---|---|---|
| 268337 | 11/1912 | Fed. Rep. of Germany | 299/86 |

*Primary Examiner*—Ernest R. Purser

*Attorney, Agent, or Firm*—Cushman, Darby & Cushman

[57] ABSTRACT

A compact and relatively lightweight rock cutting tool comprises a pair of disc cutters disposed in parallel, the disc cutters having circumferential cutting edges; a support member for the cutters disposed radially inwardly of the cutting edges thereof and on which each cutter is borne for rotation; and a mounting pedestal to which the member is attached between planes defined by the respective cutting edges of the cutters, preferably mid-way between the planes. Preferably each cutter is borne for rotation independently of the other and the cutting edges of the disc cutters are separated by 80 to 100 mm. The overall width of a tool with a separation of 90 mm between the cutting edges and with cutters of 330 mm diameter is only 180 mm which is about half that of an equivalent tool of conventional construction. With the tool of the invention therefore either more tools may be fitted to a given cutting head or more room made available at the cutting head for access to the tools and for the removal of cut rock.

10 Claims, 7 Drawing Figures

ROCK CUTTING TOOLS

The present invention relates to rock cutting tools. In particular the invention seeks to provide an improved species of cutting tool for use with tunnel boring machines, although tools in accordance with the invention may find equivalent application in raise boring, downhole drilling, mining and rock excavation in general.

The invention is concerned with cutting tools of the type which comprise so-called disc cutters. By a "disc cutter" is meant a rotary member having a circumferential cutting edge, generally defined by a ring of V-shaped cross-section. When used in tunnel boring, for example, a plurality of these tools are mounted on the rotary head of a tunnel boring machine with the axes of rotation of the various disc cutters being arrayed generally radially from the axis of rotation of the head. In operation a forward thrust is applied to the head to press the cutting edges of the tools into the formation to be reduced whilst the tools are orbited by the rotation of the head so as to roll the cutting edges along respective circular paths in contact with the formation, thereby reducing the same. Such arrangements in which each tool comprises a single disc cutter have been used in rock excavation for many years. More recently, however, twin disc cutter tools have come into use, ie tools in which a pair of disc cutters are disposed in parallel. It has been found that the use of such tools can enable higher excavation rates to be achieved than by using single disc cutter tools on an equivalent machine and it is with this particular type of tool that the invention is concerned.

Hitherto the construction of twin disc cutter tools has followed closely that of the conventional single disc cutter tools in that the cutters are mounted upon a shaft which is in turn supported at each end by a mounting yoke or saddle by which the tool can be attached to the head of a tunnel boring machine, raise borer or the like. Such a construction enables very sturdy and robust tools to be produced and it is postulated that workers in the art have considered it necessary to adopt this type of construction from a consideration of the magnitude of the loads to which the tools are subjected in conventional rock excavation. For example the mean radial loads to which disc cutters are subjected by the forward thrust of a tunnel boring machine under typical present day operating conditions can be in the order of 20 tons; intermittent or shock loading can easily increase this figure by a factor upwards of 1.5.

Investigations now indicate, however, that the most favourable ratio of machine power consumption: advance rate, (or in other words the "minimum specific energy of cutting"), for a typical present day tunnel boring machine operating with disc cutter tools, (single or double), at a given rate of head rotation, occurs at a power consumption which is considerably less than that typically employed in practice and which involves correspondingly lower tool loads. Thus, where disc cutters have hitherto been subjected to mean radial loads in the order of 20 tons, for minimum specific energy of cutting this loading may be reduced to, for example, 8 tons. This discovery leads to the possibility of adopting forms of tool construction which hitherto would be considered to be of insufficient strength.

Accordingly, the present invention resides in a rock cutting tool comprising: a pair of disc cutters disposed in parallel; a support member for said cutters disposed radially inwards of the cutting edges thereof and on which each cutter is borne for rotation; and a mounting pedestal to which said member is attached between planes defined by the respective cutting edges of the cutters.

In this way the connection of the support member to the mounting means at each end of the former, which characterises the conventional type of construction, can be avoided, so that for an equivalent disc diameter and spacing tools constructed in accordance with the invention can be considerably narrower, (ie as measured along the axis of rotation of the cutters), as well as lighter than those of conventional construction. The reduction in the space requirement of individual tools in accordance with the invention is a particularly advantageous feature as this enables a greater number of tools to be used on a given cutting head than is the case with conventional tools, to result, (other factors being equal), in improved excavation rates. Additionally or alternatively the reduced space requirement makes extra room available at the cutting head for access to the tools and for the removal of cut rock, and simplifies the head construction; in particular the use of a cruciform cutting head bearing four radial arrays of cutting tools may be feasible where hitherto conical cutting heads bearing tools at eight or more angular locations have been required.

It is a preferred feature of the invention that each disc cutter is borne for rotation independently of the other. Conventional practice with twin disc cutter tools is for the cutters to be rigidly inter-connected so as to rotate in unison. If each is of the same diameter, however, this inevitably leads to the result that one or other of the cutters is constantly scuffing, due to the fact that the cutters will in practice be used at slightly different radii from the axis of rotation of the cutter head. Wear rates are accordingly high. To counter this effect it is known to make the cutters in each pair of different diameter but it is difficult to achieve the precise difference required to eliminate all scuffing and this expedient naturally increases expense and reduces the interchangeability of cutters. By providing for independent rotation of the cutters, however, scuffing due to rolling speed differentials can be completely eliminated whilst retaining equal diameter cutters, and the wear on the cutters correspondingly reduced.

It is also a preferred feature of the invention, for reasons which will become apparent hereinafter, that the spacing between the planes of the cutting edges of the cutters is in the order of 80 to 100 mm.

The invention will now be more particularly described, by way of example, with reference to the accompanying drawings, in which.

Figure 1:
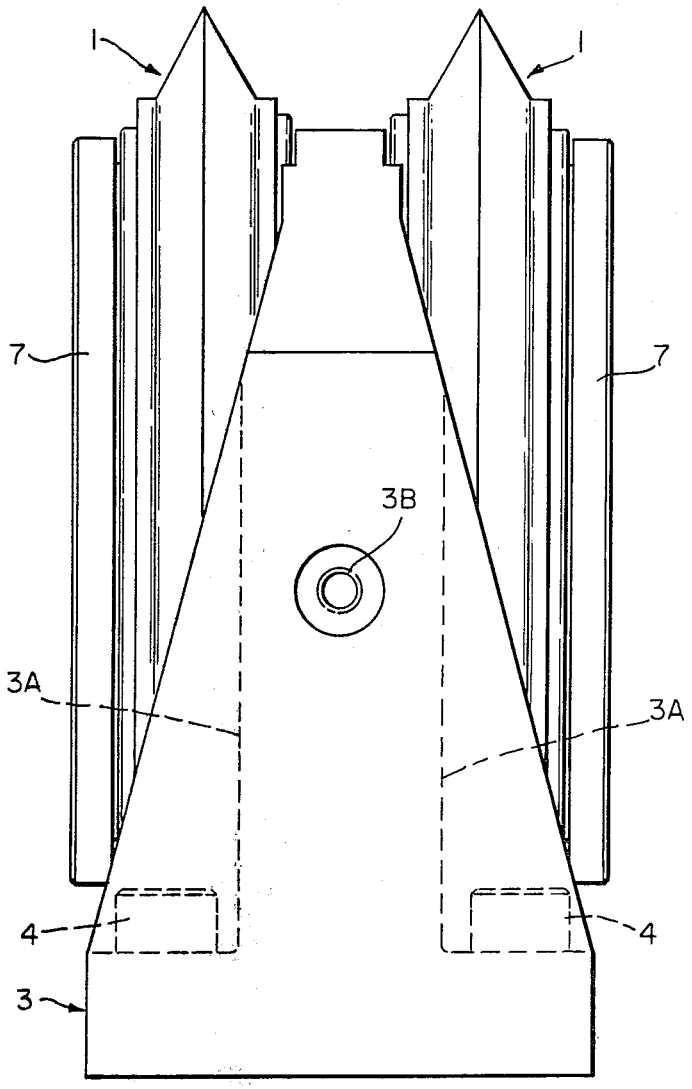
FIG. 1 is an end elevation of one embodiment of a cutting tool in accordance with the invention.
Figure 2:
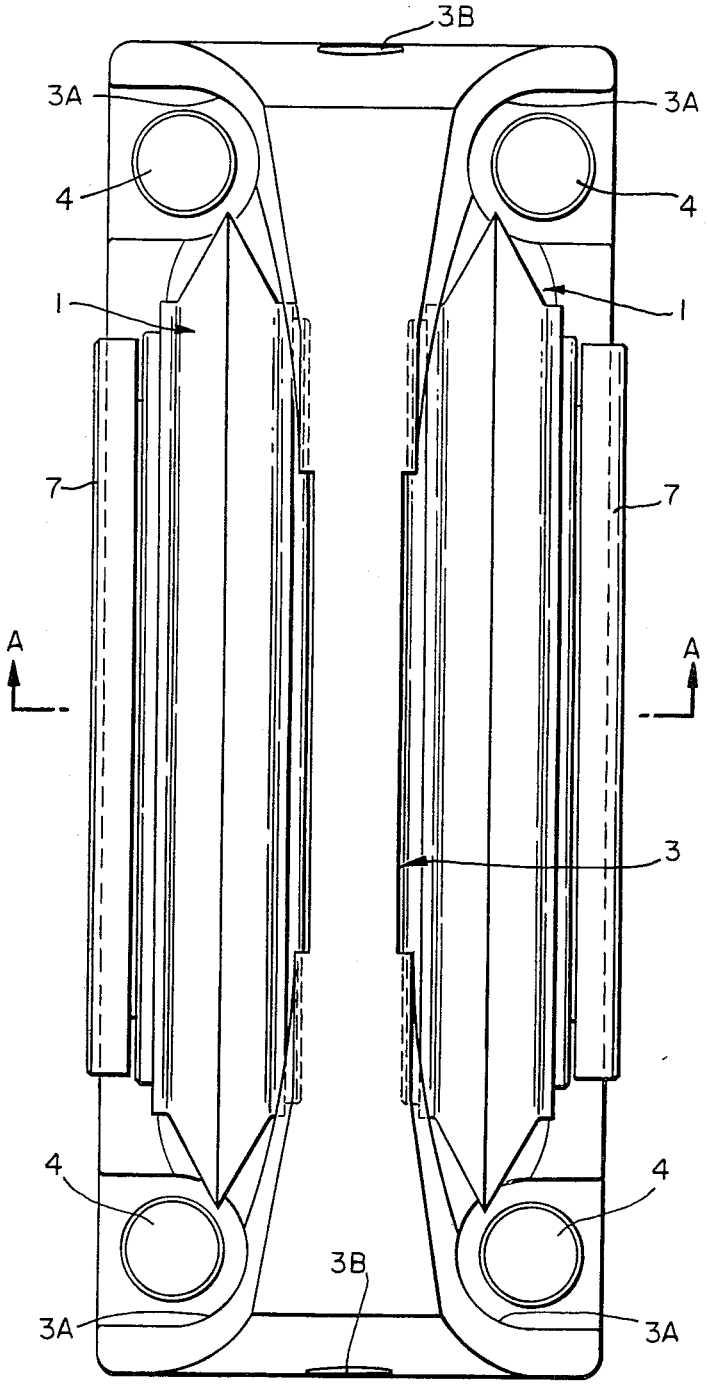
FIG. 2 is a plan view of the tool of FIG. 1.
Figure 3:
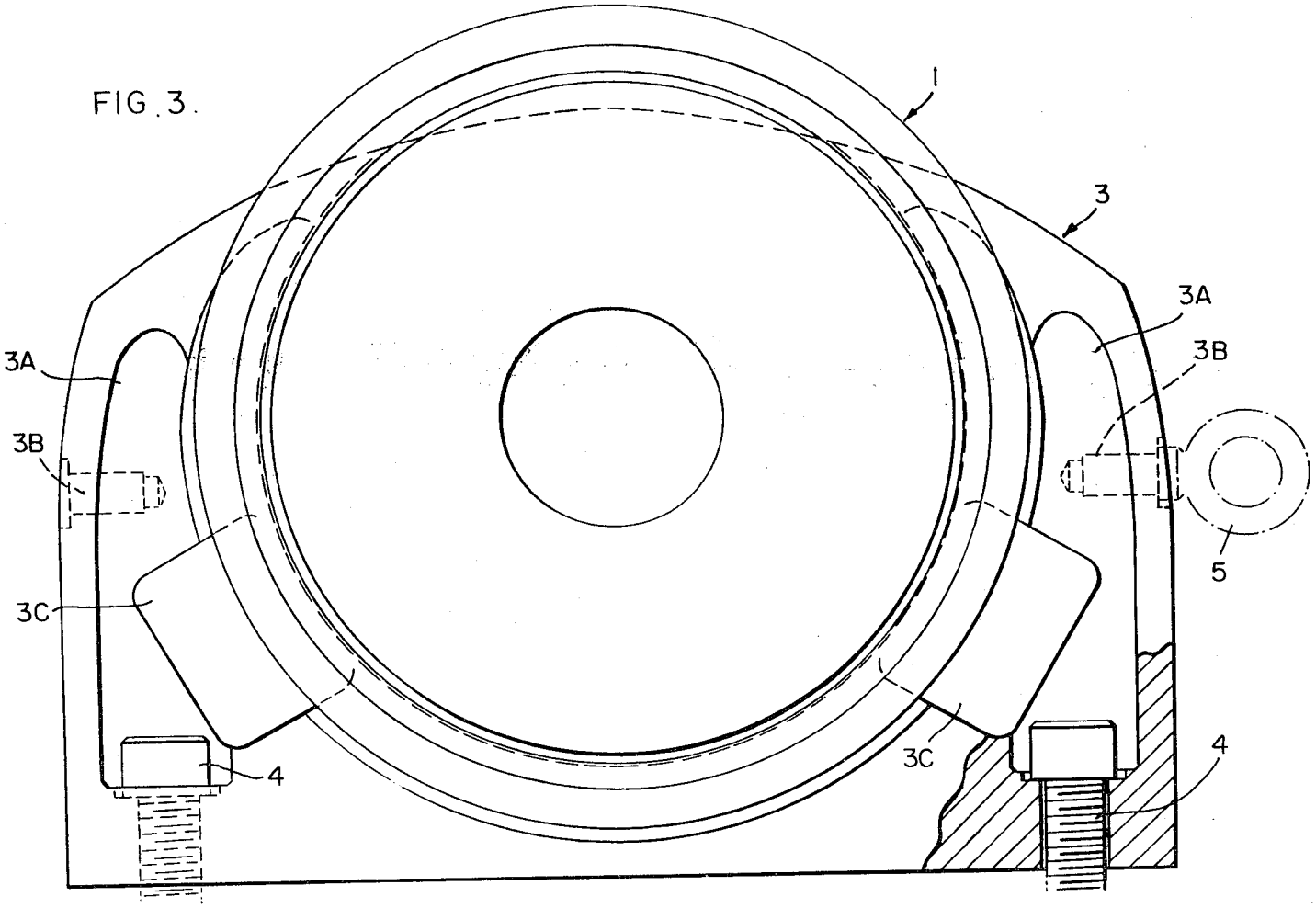
FIG. 3 is a partly schematic part-sectional side elevation of the tool of FIGS. 1 and 2.

The tool illustrated in FIGS. 1 to 4 comprises a pair of disc cutters 1 disposed in parallel and independently rotatable about a tubular support shaft 2 (FIG. 4), the latter in turn being supported by a mounting pedestal 3 by which the tool can be attached to the head of a tunnel boring machine, raise borer or the like, as by fasteners 4, (FIGS. 1–3). The pedestal 3 is relieved at 3A to permit access to the fasteners 4, and at each end of the pedestal, in line with the centre of gravity of the tool, is provided a threaded bore 3B into which an eyebolt such as 5, (FIG. 3) can be screwed to assist in the handling of the tool.

Figure 4:
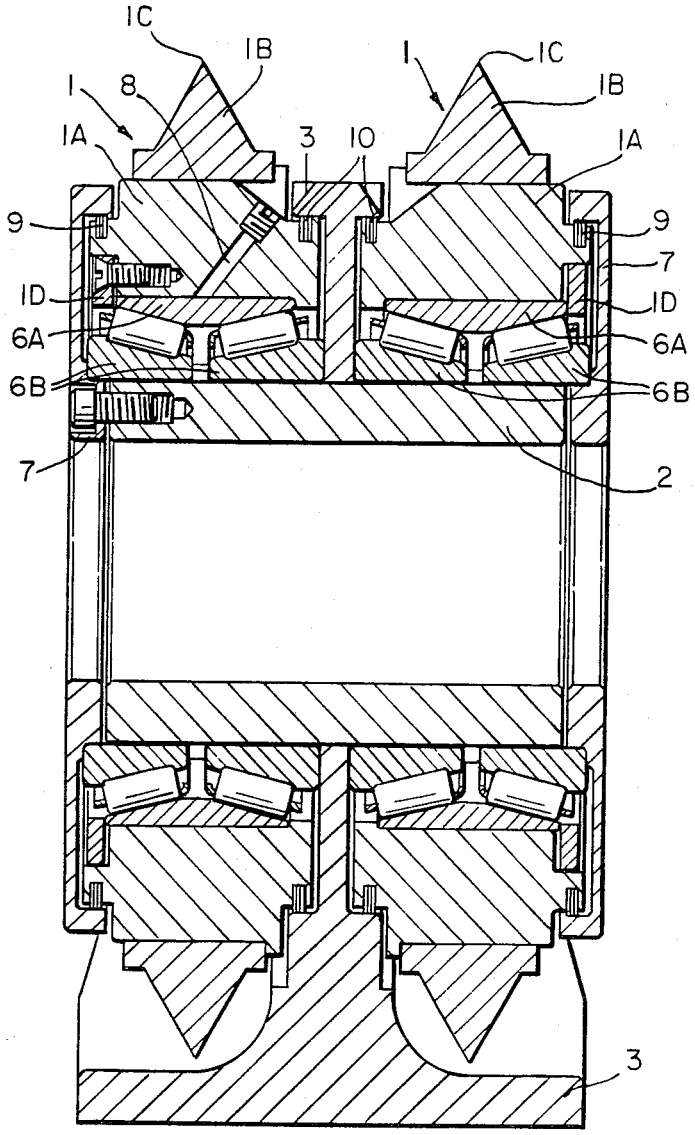
FIG. 4 is a sectional view of the tool of FIGS. 1 to 3, taken on the line AA of FIG. 2.

As shown in FIG. 4, each disc cutter 1 comprises a main body ring 1A onto which is shrink-fitted an outer ring 1B of generally V-shaped cross-section which defines a circumferential cutting edge 1C. Cut-outs 3C (FIG. 3) are provided in the pedestal 3 adjacent to the periphery of each cutter 1 for the insertion of a suitable "puller" to withdraw the outer ring 1B for replacement when worn or if damaged. With the aid of an auxiliary ring 1D each ring 1A is located upon the outer race 6A of a respective bearing assembly which occupies a volume bisected by the plane of the cutting edge of the associated cutter. The inner races 6B of the bearing assemblies are located upon the support shaft 2 between the central portion of pedestal 3 and respective side plates 7 attached to the shaft 2. Lubrication of the bearings can be effected via closeable bores such as 8 provided in the rings 1A and the bearings are protected against the loss of lubricant and the ingress of foreign matter by means of ring seals 9 and 10 which act between the rings 1A and sideplates 7 and between the rings 1A and the central portion of pedestal 3 respectively.

FIG. 4 also serves to indicate that the attachment of the support shaft 2 to the pedestal 3 is at a location mid-way between the planes of the cutting edges of the cutters 1 and it will be noted that the width of the entire tool is no more than twice the value of the lateral spacing between the planes of the cutting edges. By way of example, for a tool of the type illustrated having a cutter disc diameter of 330 mm and a spacing of 90 mm, the total tool width will be only 180 mm. This value is about one half of the typical width of an equivalent tool of conventional construction, a similar reduction in tool weight being achieved. Indeed the width and weight of such a tool may be considerably less than even a single disc cutter tool of equivalent cutter diameter and conventional construction.

Figure 5:
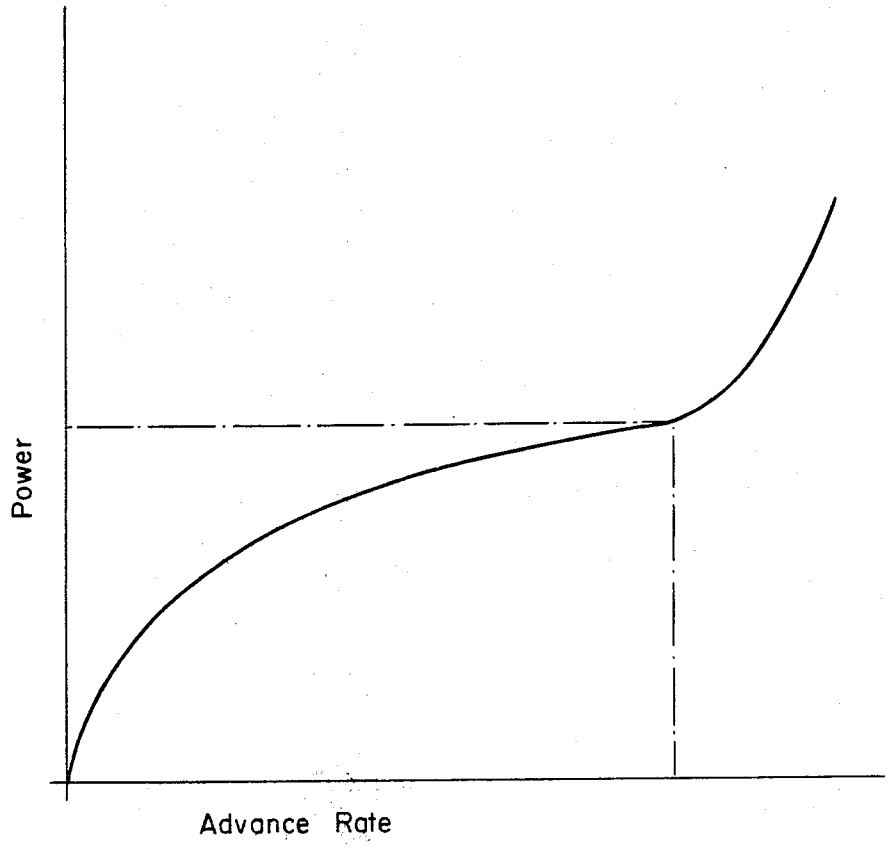
FIG. 5 is a typical curve of machine power consumption vs advance rate for a tunnel boring machine operating with disc cutter tools.

The form of construction indicated in the drawings, with the pedestal 3 being of cast iron and the various other components, (save for the seals 9 and 10), being of appropriate grades of steel, is considered to be entirely satisfactory for use under the loading conditions expected with a tunnel boring machine operated such as to achieve minimum specific energy of cutting. A typical curve of machine power consumption vs advance rate for a present day tunnel boring machine operating with disc cutter tools at a given rate of head rotation is indicated in FIG. 5, the minimum specific energy of cutting condition occuring at the indicated point of inflection. Beyond this point the ratio of power consumption: advance rate is seen to rise rapidly and it is on this part of the curve that tunnelling machines have hitherto customarily been operated.

For operation at the point of minimum specific energy of cutting it has been discovered that there is an optimum value of the lateral spacing between the planes of the cutting edges in twin disc cutter tools irrespective of the type of rock being cut, as will now be explained.

Figure 6A:
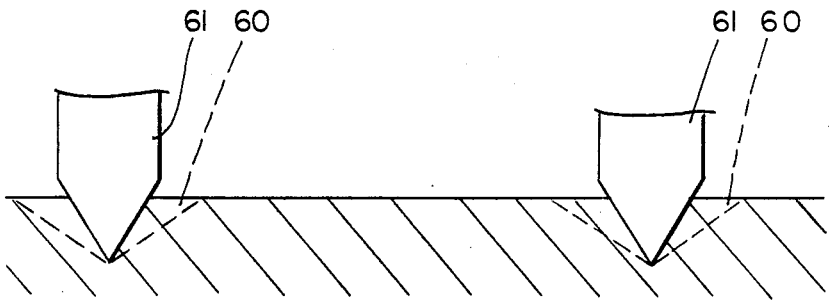
FIGS. 6*a* and *b* indicate the mode of rock removal by twin disc cutters at two different lateral spacings.
Figure 6B:
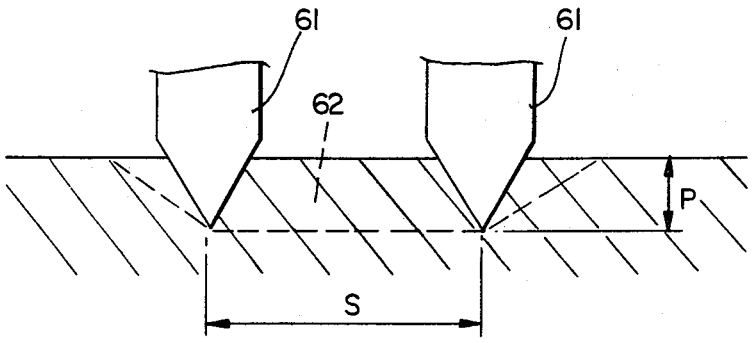

An individual disc cutter generally removes rock from the formation being cut to leave a V-shaped groove centred on the path of the cutting edge and of an apex angle greater than that of the cutter, as indicated in FIG. 6(*a*) wherein reference numerals 60 indicate the grooves cut by a pair of disc cutters 61 spaced widely apart. As the spacing between the cutters is reduced, however, a point is reached at which the cutters so interact that the band of rock lying between the cutting edges is removed completely, as indicated at 62 in FIG. 6(*b*), and it has been found that the maximum spacing at which this interaction occurs is greater than that which would be predicted simply from an estimation of the spacing at which the boundaries of the two grooves 60 would intersect. It has further been found that the maximum spacing S for such interaction to occur is related to the depth of penetration P of the cutters into the rock and that the quotient S/P increases with the hardness of the rock. Thus the value of S/P for chalk is typically 3, for sandstone 7–8, for limestone 10–12 and for granite 15–20. Corresponding to the advance rate at which minimum specific energy of cutting is achieved there is a critical value of tool penetration P, which decreases with the hardness of the rock being cut. By multiplying this value of P by the above-mentioned values of S/P for each type of rock the maximum value of S for maximum rock removal with minimum specific energy of cutting is obtained, and this has been found to work out to the same value of approximately 90 mm for each type of rock tested.

Thus for use with a tunnel boring machine operated such as to achieve minimum specific energy of cutting the theoretically optimum spacing between the planes of the cutting edges 1C for the tool illustrated in FIGS. 1 to 4 is approximately 90 mm, although to ensure complete tool interaction in practice it may be desirable to reduce this spacing a little to, say, 80 mm.

Although the foregoing disclosure has been directed particularly to the use of the illustrated type of tool with a tunnel boring machine operated so as to achieve minimum specific energy of cutting, nothing in this specification is to be taken as implying that tools in accordance with the invention are limited to such use.

I claim:

1. A full-face rock tunnelling tool comprising a pair of disc cutters disposed in parallel, said disc cutters each having a peripheral cutting edge defined by a V-shaped circumferential portion; a support member for said cutters disposed radially inwardly of the cutting edges thereof, and on which each cutter is borne for rotation independently of the other; and a mounting pedestal to which said member is attached between planes defined by the respective cutting edges of the cutters.

2. A rock tunnelling tool according to claim 1 wherein said support member is attached to the pedestal at a point midway between the planes defined by the cutting edges.

3. A rock tunnelling tool according to claim 1, wherein said planes defined by the cutting edges are spaced apart by a distance which is in the range of 80 to 100 mm.

4. A tock tunnelling tool according to claim 3, wherein said planes are spaced apart by a distance of about 90 mm.

5. A rock tunnelling tool according to claim 1, wherein the disc cutters are borne on the support member by means of rolling element bearings, each bearing having one race attached to a cutter and a complementary race attached to the support member.

6. A rock tunnelling tool according to claim 5, wherein each rolling element bearing is symmetrically disposed with respect to the plane defined by the cutting edge of its respective cutter.

7. A rock tunnelling tool according to claim 5, wherein the bearings are tapered roller bearings.

8. A full-face rock tunnelling machine having a rotary head provided with a plurality of cutter tools; each cutter tool comprising a pair of disc cutters disposed in parallel, said disc cutters each having a peripheral cutting edge defined by a V-shaped circumferential portion, a support member for said cutters disposed radially inwardly of the cutting edges thereof and on which each cutter is borne for rotation independently of the other, and a mounting pedestal to which said member is attached between planes defined by the respective cutting edges of the cutters; and each cutter tool being mounted on the rotary head by means of its respective mounting pedestal such that the axes of rotation of the disc cutters are arranged radially from the axis of rotation of the rotary head.

9. A full-face rock tunnelling machine according to claim 8, wherein, in each cutter tool, the planes of the cutting edges of the disc cutters are spaced apart by a distance which is in the range 80 to 100 mm.

10. A full-face rock tunnelling machine according to claim 8, wherein the cutting head is provided with four radial arrays of cutting tools.

* * * * *